US009580819B2

(12) United States Patent
Boe et al.

(10) Patent No.: US 9,580,819 B2
(45) Date of Patent: Feb. 28, 2017

(54) ADAPTIVE ACTIVE CATHODIC PROTECTION

(75) Inventors: Ove Boe, Tanem (NO); Gunnar Snilsberg, Heimdal (NO)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 378 days.

(21) Appl. No.: 13/825,832

(22) PCT Filed: Aug. 1, 2011

(86) PCT No.: PCT/EP2011/063197

§ 371 (c)(1),
(2), (4) Date: May 22, 2013

(87) PCT Pub. No.: WO2012/038130

PCT Pub. Date: Mar. 29, 2012

(65) Prior Publication Data

US 2013/0228471 A1 Sep. 5, 2013

(30) Foreign Application Priority Data

Sep. 24, 2010 (EP) ..... 10179504

(51) Int. Cl.
*C23F 13/00* (2006.01)
*C23F 13/04* (2006.01)
*C23F 13/20* (2006.01)

(52) U.S. Cl.
CPC ..... *C23F 13/04* (2013.01); *C23F 13/20* (2013.01); *C23F 2213/31* (2013.01)

(58) Field of Classification Search
CPC ..... C23F 13/04; C23F 13/20; C23F 13/22; C23F 2213/30; C23F 2213/31; C23F 13/02; C23F 13/08; C23F 13/18; C23F 2213/10

(Continued)

(56) References Cited

U.S. PATENT DOCUMENTS 2,903,405 A * 9/1959 Sabins ..... 204/196.06
2,987,461 A * 6/1961 Sabins ..... C23F 13/04
204/196.02

(Continued)

FOREIGN PATENT DOCUMENTS

EP 0565192 A1 10/1993 ..... C23F 13/04
RU 2086703 C1 8/1997 ..... C23F 13/22

(Continued)

OTHER PUBLICATIONS

Chinese Office Action, Application No. 201180045715.3, 16 pages, Jun. 16, 2014.

(Continued)

*Primary Examiner* — Luan Van
*Assistant Examiner* — Alexander W Keeling
(74) *Attorney, Agent, or Firm* — Slayden Grubert Beard PLLC

(57) ABSTRACT

A device comprising an electrically conductive surface portion is provided for immersion in an electrically conductive liquid such as water. At least one load electrode is provided for supplying an electric load current into the electrically conductive liquid. Further, an electrode, e.g., one or more of the at least one load electrode acts as protection electrode. A protection current source, e.g., a resistor, is electrically coupled to the conductive surface portion and to the protection electrode for providing a protection current flowing between the electrically conductive surface portion and the electrode. Further, the protection current source is adapted for changing the protection current in response to a change in the load current.

7 Claims, 2 Drawing Sheets

(58) Field of Classification Search
USPC ..... 204/196.02, 196.04, 196.37; 205/725, 205/726, 727, 740
See application file for complete search history.

(56) References Cited

U.S. PATENT DOCUMENTS

| | | | | |
|---|---|---|---|---|
| 3,714,004 | A | 1/1973 | Riggs, Jr. et al. | 205/727 |
| 6,471,851 | B1 * | 10/2002 | Bennett | C23F 13/06 204/196.1 |
| 6,498,568 | B1 | 12/2002 | Austin et al. | 340/854.5 |
| 6,506,295 | B1 * | 1/2003 | Takahashi et al. | 205/725 |
| 2006/0091001 | A1 * | 5/2006 | Drapeau | C23F 13/04 204/196.01 |
| 2007/0251834 | A1 * | 11/2007 | Bollinger | C23F 13/04 205/727 |
| 2009/0138148 | A1 * | 5/2009 | Deivasigamani | C23F 13/04 701/21 |

FOREIGN PATENT DOCUMENTS

| | | | | |
|---|---|---|---|---|
| RU | 52000 | U1 | 3/2006 | C23F 13/00 |
| WO | 02/054635 | A1 | 7/2002 | H01Q 1/04 |

OTHER PUBLICATIONS

Dickie, Neil. "Corrosion monitoring in remote or hostile locations." *Anti-Corrosion Methods and Materials*, vol. 41, No. 1, 3 pages, Jan. 1, 1997.

International Search Report and Written Opinion, Application No. PCT/EP2011/063197, 7 pages, Nov. 4, 2011.

Russian Grant Decision, Application No. 2013118688, 13 pages, Dec. 16, 2014.

* cited by examiner

ADAPTIVE ACTIVE CATHODIC PROTECTION

CROSS-REFERENCE TO RELATED APPLICATIONS

This application is a U.S. National Stage Application of International Application No. PCT/EP2011/063197 filed Aug. 1, 2011, which designates the United States of America, and claims priority to EP Patent Application No. 10179504.5 filed Sep. 24, 2010 The contents of which are hereby incorporated by reference in their entirety.

TECHNICAL FIELD

The present disclosure relates to the field of cathodic protection of devices in contact with electrically conductive liquid.

BACKGROUND

For devices in contact with an electrically conducting liquid, e.g. water, it is known to provide a fixed level of cathodic protection. In most cases such cathodic protection is provided by sacrificing anodes.

SUMMARY

One embodiment provides a device comprising an electrically conductive surface portion provided for immersion in an electrically conductive liquid; a load electrode for supplying an electric load current into the electrically conductive liquid; an electrode acting as protection electrode; and a protection current source electrically coupled to the conductive surface portion and the protection electrode for providing a protection current flowing between the electrically conductive surface portion and the electrode; the protection current source being adapted for changing the protection current in response to a change in the load current.

In a further embodiment, the load electrode is electrically coupled to the protection current source, the load electrode thereby acting as protection electrode.

In a further embodiment, the protection current source comprises a resistor electrically coupled between the load electrode and the electrically conductive surface portion.

In a further embodiment, the protection current source comprises a converter receiving electrical power from the load electrode and providing in response hereto a converted power generating the protection current.

In a further embodiment, a diode is electrically coupled between the load electrode and the protection current source.

In a further embodiment, the device further comprises a load current source coupled to the load electrode and a further load electrode coupled to the load current source.

Another embodiment provides a method of operating a device having an electrically conductive surface portion provided for immersion in an electrically conductive liquid, the method comprising supplying an electric load current into the electrically conductive liquid; and changing a protection current in response to a change in the load current, the protection current flowing between the electrically conductive surface portion and an electrode acting as protection electrode.

Another embodiment provides a computer program for controlling physical object, namely a protection current, the computer program being adapted for, when being executed by a processor device, providing any of the methods disclosed above.

BRIEF DESCRIPTION OF THE DRAWINGS

Exemplary embodiments will be explained in more detail below on the basis of the schematic drawings, wherein.

DETAILED DESCRIPTION

Figure 1:
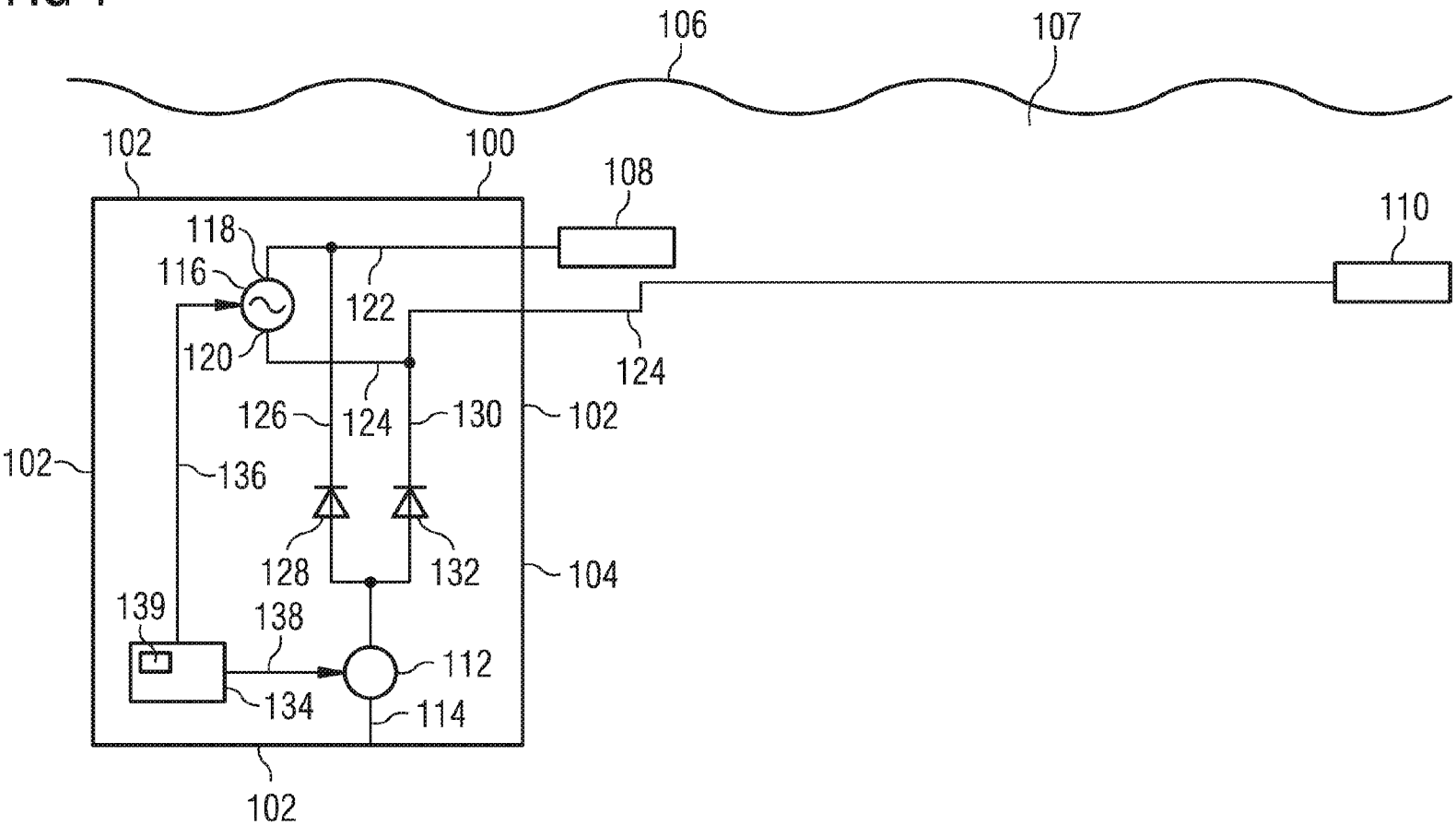
FIG. 1 shows a signal source in accordance with embodiments of the herein disclosed subject-matter.

It has been discovered that for systems used in an electrically conducting liquid where an electrical current of wiring level is flowing into the water an increased corrosion or brittle materials can result from such a varying current level flowing into the conductive liquid. Further, it has been found that increased corrosion as well as materials becoming brittle can be avoided or at least reduced with devices as disclosed herein. In some embodiments, a device is provided, the device comprising an electrically conductive surface portion provided for immersion in an electrically conductive liquid; a load electrode for supplying an electric load current into the electrically conductive liquid; an electrode acting as protection electrode; a protection current source electrically coupled to the conductive surface portion and the protection electrode for providing a protection current flowing between the electrically conductive surface portion and the protection electrode; the protection current source being adapted for changing the protection current in response to a change in the load current.

Aspect of present disclosure are based on the idea that an adaptive active cathodic protection wherein the level of cathodic protection is varied with varying load current flowing into the electrically conductive liquid increased corrosion as well as increased brittleness can be avoided. In particular, providing a protection current that increases with increasing load current and decreases with decreasing load current was found to improve the corrosion behaviour of the electrically conductive surface portion which is in contact with the electrically conductive liquid into which the electric load current is injected by the load electrode.

According to an embodiment, the load electrode is electrically coupled to the protection current source, the load electrode thereby acting as protection electrode. Such an embodiment may provide the advantage that no additional electrode is necessary for providing the improved cathodic protection in accordance with embodiments of the herein disclosed subject-matter. However, according to other embodiments, a separate protection electrode which is different from the load electrode may be provided.

According to a further embodiment, the protection current source comprises a resistor electrically coupled between the load electrode and the electrically conductive surface portion. For example, in a further embodiment, the protection current source comprises a resistor electrically coupled between the load electrode and the electrically conductive surface portion. In this way, the protection current is in a natural way proportional to the current flowing through the load electrode.

According to a further embodiment, the protection current source is a controlled current source. For example, according to an embodiment the protection current source comprises a converter receiving electrical power from the load electrode and providing in response hereto a converted power generating the protection current. For example, in a further embodiment, where the electric load current is an alternating current, the converter may comprise a transformer for transforming part of the power provided by the electric load current into a transformed AC power and a rectifier for rectifying the transformed power to thereby provide a DC power that is generally proportional to the electric load current and which is fed to the electrically conductive surface portion to thereby improve the corrosion resistance of the electrically conductive surface portion.

In accordance with certain embodiments, a diode is electrically coupled between the load electrode and the protection current source. If the load current is an AC current the diode ensures that only current flowing in the correct direction is provided to the electrically conductive surface portion.

According to a further embodiment, the device further comprises a load current source coupled to the load electrode and a further load electrode coupled to the load current source. For example, in such an embodiment having two load electrodes coupled to the load current source, the device in accordance with embodiments of the herein disclosed subject-matter may be provided for transmitting signals into the conductive liquid.

Generally herein, the electrically conductive liquid may be water, e.g. seawater or freshwater.

According to further embodiments, instead of electrically coupling the protection current source to the load electrode, the protection current source may also be electrically coupled to the load current source. According to still further embodiments, the protection current source may be an independent current source the current level of which is however coupled to vary in accordance with the variations in the load current. For example, in such embodiments, a load current sensor may be provided for sensing the load current level which may then be used as an input for a controller for controlling the protection current source.

The electrically conductive surface portion of the device as described herein may be a surface portion of a housing of the device. According to a further embodiment, the conductive surface portion is the whole surface of the housing of the device. According to a still further embodiment, the device is a subsea device which is intended for operation below sea level.

In other embodiments, a method of operating a device having an electrically conductive surface portion provided for immersion in the electrically conductive liquid is provided, the method comprising supplying an electric load current into the electrically conductive liquid; and changing a protection current in response to a change in the load current, the protection current flowing between the electrically conductive surface portion and an electrode acting as protection electrode.

According to an embodiment, the method includes features or provides functions as correspondingly described with regard to the first aspect.

According to other embodiments, a computer program for controlling physical object, namely a protection current, is provided, the computer program being stored in non-transitory computer-readable media and executable by a data processor for providing any of the methods disclosed herein.

As used herein, reference to a computer program is intended to be equivalent to a reference to a program element and/or a computer readable medium containing instructions for controlling a computer system to coordinate the performance of the above described method.

The computer program may be implemented as computer readable instruction code by use of any suitable programming language, such as, for example, JAVA, C++, and may be stored on a computer-readable medium (removable disk, volatile or non-volatile memory, embedded memory/processor, etc.). The instruction code is operable to program a computer or any other programmable device to carry out the intended functions. The computer program may be available from a network, such as the World Wide Web, from which it may be downloaded.

Embodiments may be realized by means of a computer program respectively software. However, other embodiments may be realized by means of one or more specific electronic circuits respectively hardware. Furthermore, some embodiments may also be realized in a hybrid form, i.e., in a combination of software modules and hardware modules.

In the above there have been described and in the following there will be described exemplary embodiments with reference to a device and a method for operating a device. It has to be pointed out that of course any combination of features relating to different aspects of the herein disclosed subject matter is also possible. In particular, some embodiments have been described with reference to apparatus type embodiments whereas other embodiments have been described with reference to method type embodiments. However, a person skilled in the art will gather from the above and the following description that, unless other notified, in addition to any combination of features belonging to one aspect also any combination between features relating to different aspects or embodiments, for example even between features of the apparatus type embodiments and features of the method type embodiments is considered to be disclosed with this application.

FIG. 1 shows a signal source 100 having an electrically conductive surface portion 102. The electrically conductive surface portion 102 is the surface of a housing 104 of the signal source 100. The housing 104 sealingly encloses the further components of the signal source 100 and thereby allows an operation of the signal source 100 below a liquid level (e.g. below sea level) which is indicated at 106 in FIG. 1. The surface 102 of the housing 104 is therefore configured and intended for immersion in an electrically conductive liquid 107 such as water, for example seawater.

In accordance with an embodiment, the signal source 100 comprises a first load electrode 108 and a second load electrode 110. The load electrodes 108, 110 are located at a certain distance with respect to each other, depending on the application.

In accordance with an embodiment, where the signal source 100 is configured for providing signals into the water 107, the load electrodes 108, 110 may also be referred to as antenna electrodes.

In accordance with an embodiment of the herein disclosed subject-matter, the two load electrodes 108, 110 also serve as protection electrode being electrically coupled to a protection current source 112. The protection current source 112 is electrically coupled to the electrically conductive surface portion 102, e.g. by an electrical line 114. According to other embodiments, one or more separate protection electrodes are provided and electrically coupled to the protection current source 112.

The signal source 100 further comprises a load current source 116 which in one embodiment is an AC current source. The load current source 116 has two output terminals 118, 120, of which a first output terminal 118 is coupled to the first load electrode 108 and of which a second output terminal 120 is coupled to the second load electrode 110. Electrical coupling between the output terminals 118, 120 of the load current source 116 and the load electrodes 108, 110 may be performed by any suitable means, e.g. by electrical lines 122, 124. In accordance with a further embodiment, the protection current source 112 is electrically coupled between each of the load electrodes 108, 110 and the electrically conductive surface portion 102, as shown in FIG. 1.

In accordance with an embodiment, a current path 126 between the first load electrode 108 and the protection current source 112 comprises a first diode 128. Likewise, the current path 130 between the second load electrode 110 and the protection current source 112 comprises a second diode 132. The diodes 128, 132 ensure that only protection current with the correct polarity is provided to the electrically conductive surface portion 102. In accordance with an embodiment, the polarity of the diodes 128, 132 with regard to the current flow such that cathodic protection of the electrically conductive surface portion 102 is achieved.

In accordance with a further embodiment, the signal source 100 comprises a controller 134 for controlling the load current source 116 via control signals 136. In accordance with a further embodiment, the controller 134 is configured for providing control signals 138 to the protection current source 112 to thereby control the protection current source 112 in accordance with the load current source 116. By means of the control signals 138, the controller 134 may be configured for actively controlling the protection current provided by the protection current source 112 to the electrically conductive surface 102. As a power input, the protection current source 112 may be electrically coupled to the output terminals of the load current generator 116. According to other embodiments, a separate controller (not shown in FIG. 1) is provided for controlling the protection current source 112. The separate controller may be provided similar to the controller 134 and may be configured for providing the functionality as described in embodiments having regard to the protection current source.

According to an embodiment, the controller 134 is configured for changing the protection current so as to monotonously increase the protection current with increasing load current. In other words, in such an embodiment the protection current is the higher, the higher the load current is. According to a further embodiment, the controller 134 is configured for changing the protection current so as to monotonously increase a mean value of the protection current with increasing load current. According to an embodiment the mean value of the protection current is calculated by averaging the protection current over a predetermined time period. For example, in an embodiment, the time period is equal to or larger than the periodicity of an AC load current.

In accordance with an embodiment, the controller 134 comprises a processor device 139 having at least one processor for carrying out a computer program implementing one or more functions of the device 100 as described herein.

According to an embodiment, a summing point 140 is provided, wherein each load electrode 108, 110 is electrically coupled to the summing point via a diode, e.g. the respective diode 128, 132 in order to provide a DC current (or a respective DC voltage) to the summing point 140 if the current flowing between the load electrodes 108, 110 has the correct polarity. In an embodiment, the protection current source 112 is electrically coupled between the summing point 140 and the electrically conductive surface portion 102.

In accordance with an embodiment, the controller 134 comprises a processor device having at least on processor for carrying out computer programs having implemented therein software modules implementing aspects and embodiments of the herein disclosed subject matter.

Figure 2:
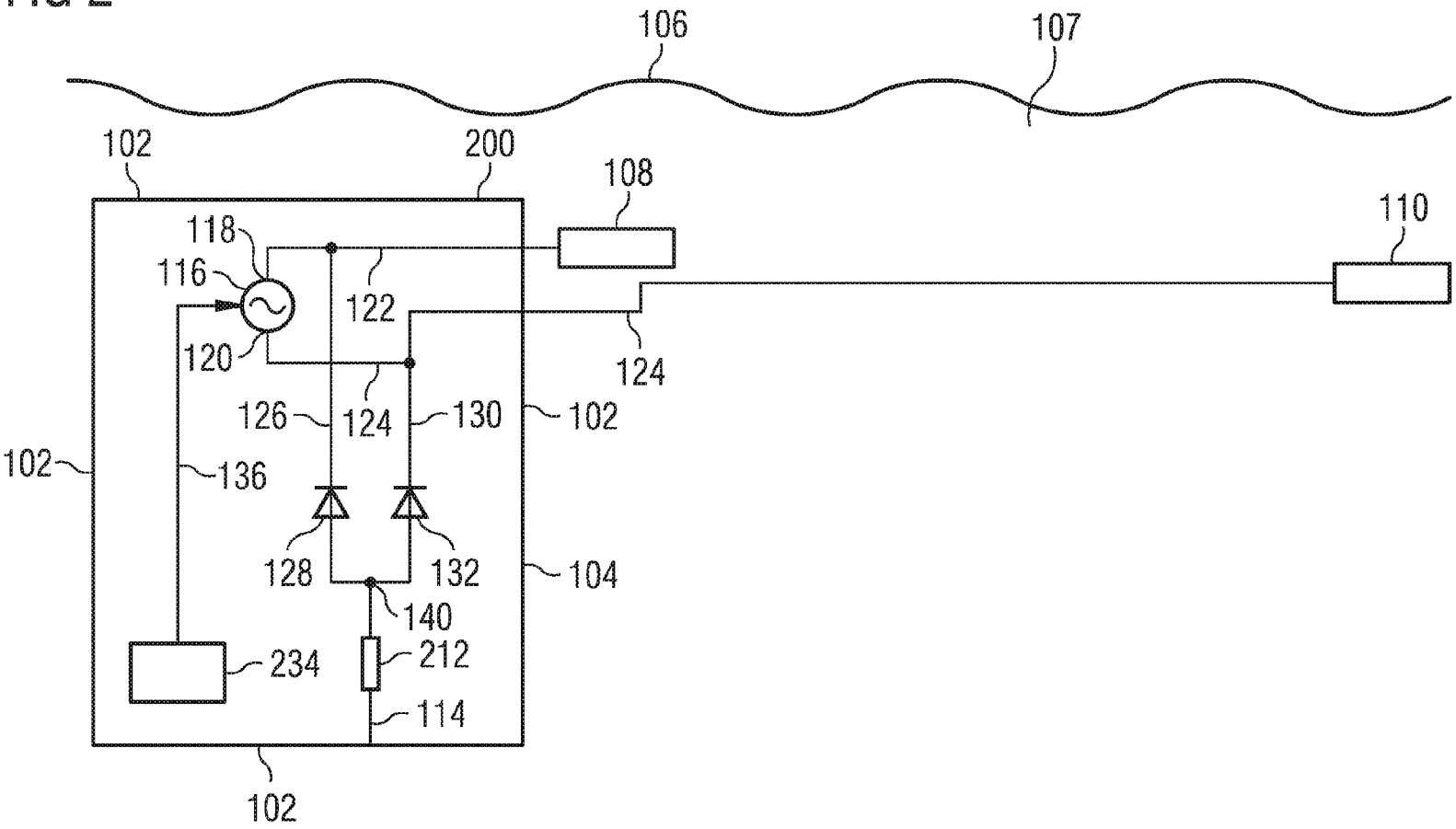
FIG. 2 shows a further signal source in accordance with embodiments of the herein disclosed subject-matter.

FIG. 2 shows a signal source 200 in accordance with embodiments of the herein disclosed subject-matter.

Elements of the signal source 200 which are similar or identical to elements of the signal source 100 described with regard to FIG. 1 are provided with the same reference signs and the description thereof is not repeated here. Rather, differences between the signal source 100 of FIG. 1 and the signal source 200 of FIG. 2 are discussed in the following.

The controller 234 of the signal source 200 is provided only for controlling the load current source 116. In accordance with an embodiment shown in FIG. 2, the protection current source 212 of the signal source 200 does not require an active control but is rather self-controlled, i.e. controls itself depending on the load current level provided to the load electrodes 108, 110. For example, in accordance with an embodiment, the protection current source 212 may comprise a resistor or may consist of a resistor as shown in FIG. 2. For example, a resistor 212 may be electrically coupled between the load electrodes 108, 110 and the electrically conductive surface portion 102. In particular, in accordance with an embodiment shown in FIG. 2, the resistor 212 is coupled in a current path extending between the first load electrode 108 and the electrically conductive surface portion 102 and comprising current path components 126, 114. In accordance with an further embodiment shown in FIG. 2, the resistor 212 is coupled in a current path extending between the second load electrode 110 and the electrically conductive surface portion 102 and comprising current path components 130, 114.

Similar to the configuration in FIG. 1, diodes 128, 132 are provided which diodes are coupled in the current path component 126, 130 between the respective electrode 108, 110 and the resistor 212. The diodes 128, 132 ensure that only current of the correct direction, i.e. current that serves to cathodically protect the electrically conductive surface portion is provided to the electrically conductive surface portion 102.

According to an embodiment, a summing point 140 is provided, wherein each load electrode is electrically coupled to the summing point via a diode, e.g. the respective diode 128, 132 in order to drive a current through the summing point if the current flowing between the load electrodes 108, 110 has the correct polarity. In an embodiment, the resistor 212 is electrically coupled between the summing point 140 and the electrically conductive surface portion 102.

In accordance with a further embodiment, instead of a resistor a transformer may be provided. By the transformer the voltage level as well as the current level of the protection current provided to the electrically conductive surface portion may be adjusted with regard to the current level of the load current supplied to the load electrodes 108, 110.

The signal source as shown in FIG. 2 and in particular embodiments of the herein disclosed subject-matter which do not contain an actively controlled protection current source but rather contain a self-controlled protection current source, such as a resistor 212 or a transformer, may have the advantage of a very simple circuit design, reduce cost while at the same time providing good corrosion protection of the electrically conductive surface portion 102, e.g. the surface of the housing 104.

Having regard to the subject matter disclosed herein, it should be mentioned that generally embodiments referring to a signal source are considered so as to implicitly disclose a device in general, the device having features in accordance with embodiments described with regard to signal source.

It should further be noted that any entity disclosed herein, e.g. a control unit, is not limited to dedicated entities as described in some embodiments. Rather, the herein disclosed subject matter may be implemented in various ways having features and entities in various locations in the device while still providing the desired functionality.

According to some embodiments, any suitable entity (e.g. components, units and devices) disclosed herein, e.g. the controller 134, are at least in part provided in the form of respective computer programs which enable a processor device to provide the functionality of the respective entities as disclosed herein. According to an embodiment, the controller 134 comprises a processor device 139. According to another embodiment, the controller 134 comprises a processor device being configured for being capable of running a computer program thereon, the computer program providing the respective functionality of the controller 134 as described herein. According to other embodiments, any suitable entity disclosed herein may be provided in hardware. According to other—hybrid—embodiments, some entities may be provided in software while other entities are provided in hardware.

It should be noted that any entity disclosed herein (e.g. components, units and devices) are not limited to a dedicated entity as described in some embodiments. Rather, the herein disclosed subject matter may be implemented in various ways and with various granularity on device level while still providing the desired functionality. Further, it should be noted that according to embodiments a separate entity (e.g. a software module, a hardware module or a hybrid module) may be provided for each of the functions disclosed herein. According to other embodiments, an entity (e.g. a software module, a hardware module or a hybrid module (combined software/hardware module)) is configured for providing two or more functions as disclosed herein.

It should be noted that the term "comprising" does not exclude other elements or steps and the "a" or "an" does not exclude a plurality. Also elements described in association with different embodiments may be combined. It should also be noted that reference signs in the claims should not be construed as limiting the scope of the claims.

Thus, according to the above described embodiments:

There is provided a device comprising an electrically conductive surface portion provided for immersion in an electrically conductive liquid such as water. At least one load electrode is provided for supplying an electric load current into the electrically conductive liquid. Further, an electrode, e.g. one or more of the at least one load electrode acts as protection electrode. A protection current source, e.g. a resistor, is electrically coupled to the conductive surface portion and to the protection electrode for providing a protection current flowing between the electrically conductive surface portion and the electrode. Further, the protection current source is adapted for changing the protection current in response to a change in the load current.

What is claimed is:

1. A device for transmitting signals into a conductive liquid, the device comprising:

a signal source having a housing configured for immersion in the electrically conductive liquid, the housing protecting the signal source from contact with the electrically conductive liquid;

an electrically conductive surface portion of the housing exposed to the electrically conductive liquid;

a load electrode configured to supply an electric load current into the electrically conductive liquid;

an antenna electrode configured for immersion in the electrically conductive liquid a distance from the electrically conductive surface to act as a protection electrode; and a load current source and a protection current source within the housing;

wherein the load current source provides a load current to the load electrode;

wherein the protection current source includes a resistor electrically coupled between the electrically conductive surface portion and the antenna electrode and is configured to provide a protection current flowing between the electrically conductive surface portion and the antenna electrode and to increase the protection current in response to an increase in the load current.

2. The device of claim 1, wherein the protection current source comprises a converter configured to receive electrical power from the antenna electrode and, in response, to provide a converted power that generates the protection current.

3. The device of claim 1, wherein a diode is electrically coupled between the antenna electrode and the protection current source.

4. The device of claim 1, further comprising:

a further antenna electrode coupled to the load current source or the protection current source.

5. The device of claim 1, wherein the protection current source further comprises a converter configured to receive electrical power from the antenna electrode and, in response, to provide a converted power that generates the protection current.

6. A device for transmitting signals into an electrically conductive liquid, the device comprising:

a signal source for transmitting signals into a conductive liquid, the signal source comprising a housing configured for immersion into and protecting the signal source from contact with an electrically conductive liquid;

a load electrode configured to supply an electric load current into the electrically conductive liquid;

a protection electrode configured to be immersed in the electrically conductive liquid a distance from the load electrode and an electrically conductive surface portion of the signal source;

a load current source and a protection current source within the housing;

wherein the load current source provides a load current to the load electrode;

wherein the protection current source includes a resistor electrically coupled between the conductive surface portion of the signal source and the protection electrode and is configured to:

provide a protection current flowing between the electrically conductive surface portion of the signal source and the protection electrode; and increase the protection current in response to an increase in the load current.

7. A device for transmitting signals into an electrically conductive liquid, the device comprising:

a signal source for transmitting signals into a conductive liquid, the signal source comprising a housing configured for immersion in and to protect the signal source from contact with the electrically conductive liquid;

an antenna load electrode configured to be immersed in the electrically conductive liquid a distance away from an electrically conductive surface portion of the housing and to supply an electric load current into the electrically conductive liquid, an antenna protection electrode configured to be located in the electrically conductive liquid a distance from the electrically conductive surface portion of the housing and the antenna load electrode;

a load current source and a protection current source resistor within the housing;

wherein the load current source provides a load current to the antenna load electrode;

wherein the protection current source resistor is electrically coupled between the conductive surface portion of the signal source and the antenna protection electrode and is configured to:

provide a protection current flowing between the electrically conductive surface portion of the signal source and the antenna protection electrode; and increase the protection current in response to an increase in the load current.

* * * * *